US005080564A

United States Patent [19]

Kasahara et al.

[11] Patent Number: 5,080,564

[45] Date of Patent: Jan. 14, 1992

[54] PRESTROKE CONTROL DEVICE FOR FUEL INJECTION PUMPS

[75] Inventors: Toshiaki Kasahara; Kenichi Kubo; Hiroshi Ishiwata; Toru Yokota; Susumu Yamaguchi, all of Higashimatsuyama, Japan

[73] Assignee: Diesel Kiki Co., Ltd., Tokyo, Japan

[21] Appl. No.: 469,921

[22] Filed: Jan. 24, 1990

[30] Foreign Application Priority Data

| | | | |
|---|---|---|---|
| Feb. 8, 1989 | [JP] | Japan | 1-13707[U] |
| Mar. 31, 1989 | [JP] | Japan | 1-83699 |
| Aug. 25, 1989 | [JP] | Japan | 1-98511[U] |
| Aug. 25, 1989 | [JP] | Japan | 1-98512[U] |
| Aug. 25, 1989 | [JP] | Japan | 1-98513[U] |

[51] Int. Cl.[5] ..... F04B 39/10; F02M 59/20

[52] U.S. Cl. ..... 417/494; 123/449; 123/364

[58] Field of Search ..... 417/494, 499; 123/364, 123/365, 370, 503, 449, 357

[56] References Cited

U.S. PATENT DOCUMENTS

| | | | |
|---|---|---|---|
| 4,403,582 | 9/1983 | Yasumara | 123/503 |
| 4,635,602 | 1/1987 | Emeim | 123/503 |
| 4,661,051 | 4/1987 | Nakamura | 417/499 |
| 4,705,005 | 11/1987 | Guntert | 123/503 |
| 4,708,114 | 11/1987 | Guntert | 417/494 |
| 4,738,601 | 9/1988 | Guntert | 417/499 |

*Primary Examiner*—Richard A. Bertsch
*Assistant Examiner*—Peter Korytnyk
*Attorney, Agent, or Firm*—Charles S. McGuire

[57] ABSTRACT

A prestroke control device for a fuel injection pump includes at least one control sleeve slidably fitted on at least one plunger, a control rod engaging the control sleeve, the control rod extending perpendicularly to the plunger and rotatable about an axis thereof for varying an axial position of the control sleeve relative to the plunger to thereby control the prestroke of the plunger, and an actuator for rotatively driving the control rod about its own axis. A counterweight is movable in unison with rotation of the control rod for cancelling a rotating force generated by axial movement of the control sleeve and acting upon the control rod.

4 Claims, 16 Drawing Sheets

PRESTROKE CONTROL DEVICE FOR FUEL INJECTION PUMPS

BACKGROUND OF THE INVENTION

This invention relates to a prestroke control device for fuel injection pumps, and more particularly to a device of this kind which controls the prestroke of the plunger by means of a control sleeve sliding on the plunger.

A prestroke control device for fuel injection pumps for use in diesel engines has been proposed, e.g. by Japanese Provisional Utility Model Publication (Kokai) No. 61-118936, which varies the prestroke of the plunger (the stroke from a lift-starting position of the plunger to an injection-starting position thereof), in order to control the fuel injection timing and the fuel injection rate.

The proposed prestroke control device comprises a control rod engaging a control sleeve slidably fitted on a plunger, the control rod being rotatable about its own axis for varying the axial position of the control sleeve relative to the plunger, an engaging member provided at one end of the control rod, and a prestroke actuator engaging the engaging member for rotatively driving via the engaging member the control rod about its own axis.

More specifically, as shown in FIG. 1, the plunger 2 has a fuel passage 5 formed therein, and an inclined groove 6 formed in an outer peripheral surface thereof. The control sleeve 3 is slidably fitted on the plunger 2, which has a spill port 7 formed therein for communication with the inclined groove 6 of the plunger 2. The spill port 7 opens into a fuel chamber 9 defined within a plunger barrel 8 in which the plunger 2 is slidably received.

The control sleeve 3 has a circumferentially extending notched groove 10 formed in an outer peripheral surface thereof, in which is engaged a spherical end 12 of a lever 11 radially outwardly extending from the control rod 4. As the control rod 4 is rotated about its own axis, the lever 11 is pivotally moved in a direction indicated by the arrow B in FIG. 1 to displace the control sleeve 3 in a direction indicated by the arrow A, whereby the prestroke of the plunger 1 varies.

As shown in FIG. 2, the prestroke actuator 14 is coupled to a U-shaped member (engaging member) 19 secured to an end of the control rod 4 to rotatively drive the control rod 4 about its own axis via the member 19. The actuator 14 is controlled by means of a controller, not shown, in response to the rotational speed of an engine associated with the fuel injection pump and the load on the engine.

In the illustrated example, the actuator 14 is essentially comprised of a rotor 16 which is electromagnetically actuated to rotate against the force of a return spring 15 by a required amount. The rotor 16 has an output shaft 17 carrying at its tip an eccentric engaging ball 18 engaged in a U-shaped groove in the U-shaped member 19, whereby the control rod 4 is rotated about its own axis by the actuator 14 when the latter is energized.

In the conventional prestroke control device constructed as above, the control sleeve 3 can be dislocated from its controlled position due to vibrations transmitted from the engine or vibrations generated by the pump per se. The dislocation of the control sleeve 3 is attributable to the fact that the center of gravity of the control sleeve as a moving part is distant from the axis of rotation of the control rod 4 so that when a force (vibrating force) caused by the above-mentioned vibrations acts upon the control sleeve 3, the resulting rotating force is applied to the control rod 4 to cause same to rotate. The dislocation of the control sleeve 3 thus results in a change in the prestroke of the plunger, adversely affecting the injection timing, the injection rate and even the injection quantity, and hence torque fluctuations and degraded exhaust emission characteristics of the engine.

SUMMARY OF THE INVENTION

It is therefore the object of the invention to provide a prestroke control device which is capable of preventing the control sleeve from being dislocated axially of the plunger due to vibrations transmitted from the engine or vibrations of the pump per se, and hence preventing variations in the prestroke of the plunger.

To attain the above object, the present invention provides a prestroke control device for a fuel injection pump having at least one plunger, the device including at least one control sleeve slidably fitted on a corresponding one of the at least one plunger, a control rod engaging the control sleeve, the control rod extending perpendicularly to the plunger and rotatable about its own axis for varying an axial position of the control sleeve relative to the plunger to thereby control a prestroke of the plunger, and actuator means for rotatively driving the control rod about its own axis.

The prestroke control device according to the invention is characterized by an improvement comprising counterweight means movable in unison with rotation of the control rod for cancelling a rotating force generated by axial movement of the control sleeve and acting upon the control rod.

In one form, the actuator means has an engaging member secured to said control rod for rotation together therewith, the counterweight means comprising a weight secured to the engaging member for pivotal movement in unison with rotation of the engaging member.

In another form, the control rod comprises a main body, at least one lever extending through the main body and fitted in a grooved formed in a corresponding one of the at least one control sleeve, and at least one lock screw holding a corresponding one of the at least one lever in the main body. The counterweight means comprises the lock screw having an increased weight.

In still another form, the counterweight means comprises the control rod having a center of gravity eccentrically located on a side remote from the control sleeve with respect to the axis of rotation of the control rod.

The counterweight means may comprise a moving core arranged for linear movement in unison with rotation of the control rod.

The moving core may be a part of a differential transformer, which may operate as a sensor for sensing rotational displacement of the control rod. Alternatively, the moving core may be a part of an electromagnetic actuator forming the actuator means.

Preferably, the moving core is disposed to move in directions parallel with the axis of the plunger.

Also preferably, the counterweight means includes reversing means coupled to the control rod for rotation in a direction reverse to the direction of rotation of the control rod, the weight being connected to the reversing means for movement together therewith.

The counterweight means may comprise a moving core specified as above, which is disposed for linear movement in unison with rotation of the reversing means.

Alternatively, the weight may be secured to the reversing means for pivotal movement together therewith.

In a preferred form, the counterweight means comprises a guide rod arranged parallel with the an axis of the plunger, a counterweight slidably fitted on the guide rod and having a groove formed in an outer peripheral surface thereof, and a rod extending from the reversing means and having an end thereof engaged in the groove.

The reversing means may comprise a pair of toothed members engaging each other.

The above and other objects, features, and advantages of the invention will be more apparent from the ensuing detailed description taken in conjunction with the accompanying drawings.

DETAILED DESCRIPTION

Figure 1:
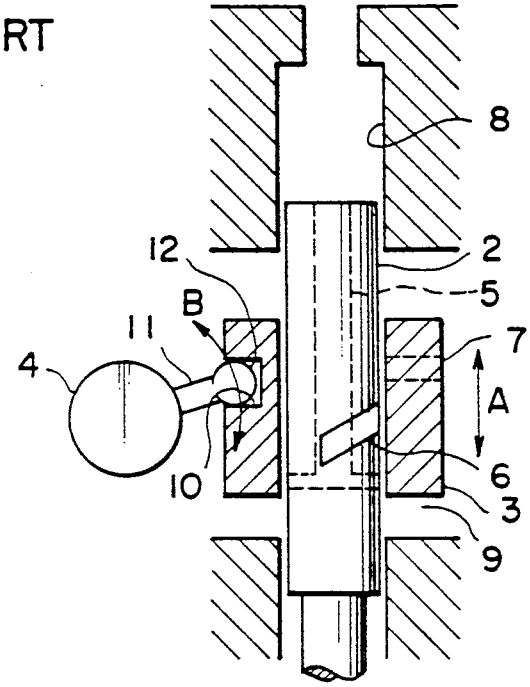
FIG. 1 PRIOR ART
FIG. 1 is a schematic fragmentary longitudinal sectional view of essential parts of a conventional prestroke control device of a fuel injection pump.

The invention will now be described in detail with reference to the drawings showing several embodiments thereof. Corresponding or similar parts and elements are designated by identical reference numerals throughout all the views showing the embodiments, and description of the construction and operation of corresponding or similar parts and elements to those of the first embodiment is omitted from the description of the second to ninth embodiments.

Figure 3:
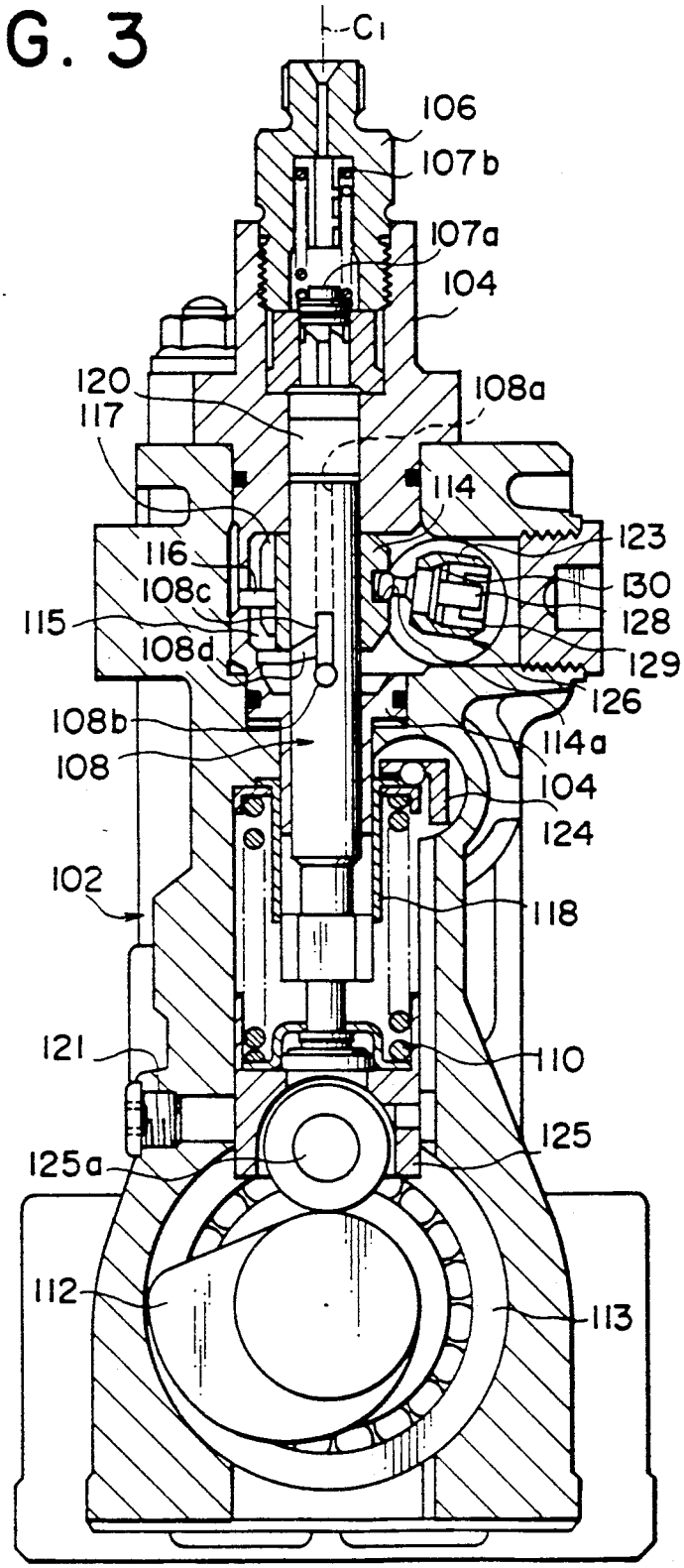
FIG. 3 is a longitudinal sectional view of a fuel injection pump incorporating a prestroke control device according to the present invention.

FIGS. 3 through 7 show a first embodiment of the invention. Referring first to FIG. 3 reference numeral 102 designates a housing of an in-line type fuel injection pump, and 104 a plunger barrel mounted in the housing 102. A plurality of plunger barrels 104 are arranged along a line in the housing 102, though only one of them is shown in FIG. 3. Reference numeral 106 designates a delivery valve holder of a delivery valve mounted in an upper end of the plunger barrel 104. A plurality of delivery valve holders 106 are connected to respective cylinders of an engine, not shown, though only one of them is shown in the figure. Reference numeral 107*a* designates a valve body of the delivery valve, 108 a plunger slidably received in the barrel 104, 110 a spring downwardly urging the plunger 108, 112 a camshaft coupled to an output shaft, not shown, of the engine for driving the plunger 108 for reciprocating motion via a roller 125*a* of a tappet 125, 113 a camshaft chamber accommodating the camshaft 112, 114 a control sleeve slidably fitted on the plunger 108 (a plurality of control sleeves 114 are arranged in a line, though only one of them is shown), 116 a guide pin secured to the barrel 104 and engaging a guide groove 117 formed in the control sleeve 114 for inhibiting rotation of the sleeve 114, and 118 a sleeve slidably fitted on the plunger barrel 104 and engaging the plunger 108 in a manner rotatable therewith.

Figure 4:
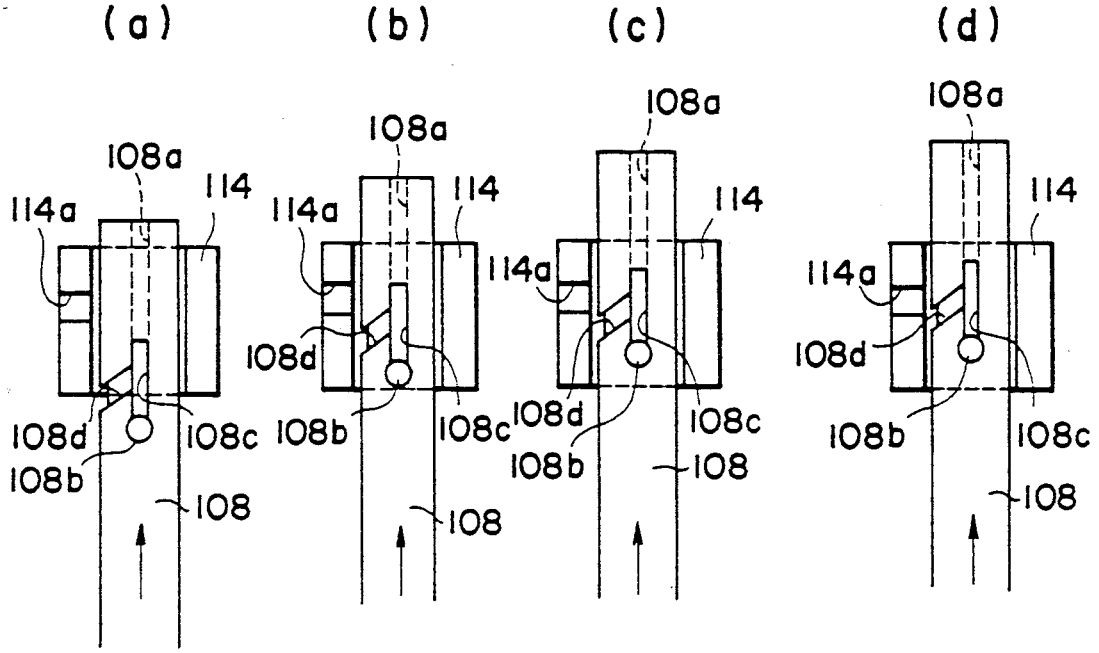
FIGS. 4 (a) - (d) are diagrammatic views useful in explaining the positional relationship between the plunger and the control sleeve.

The plunger 108 is formed with an internal fuel passage 108*a* opening in an upper end face of the plunger, an opening 108*b* opening in an outer peripheral surface of the plunger in communication with the fuel passage 108*a*, a longitudinal groove 108*c* formed in the outer peripheral surface in communication with the opening 108*b*, and an inclined groove 108*d* formed in the outer peripheral surface in communication with the longitudinal groove 108*c*. The control sleeve 114 is formed therein with a control port (spill port) 114*a* which determines the fuel injection end, as shown in FIG. 4.

In FIG. 3, reference numeral 115 denotes a fuel chamber in which fuel oil supplied from a feed pump, not shown, is temporarily stored, 120 a pressurizing chamber in which fuel is pressurized by the plunger 108, and 121 a lubricating oil supply port through which lubricating oil is delivered to the camshaft chamber 113.

Figure 5:
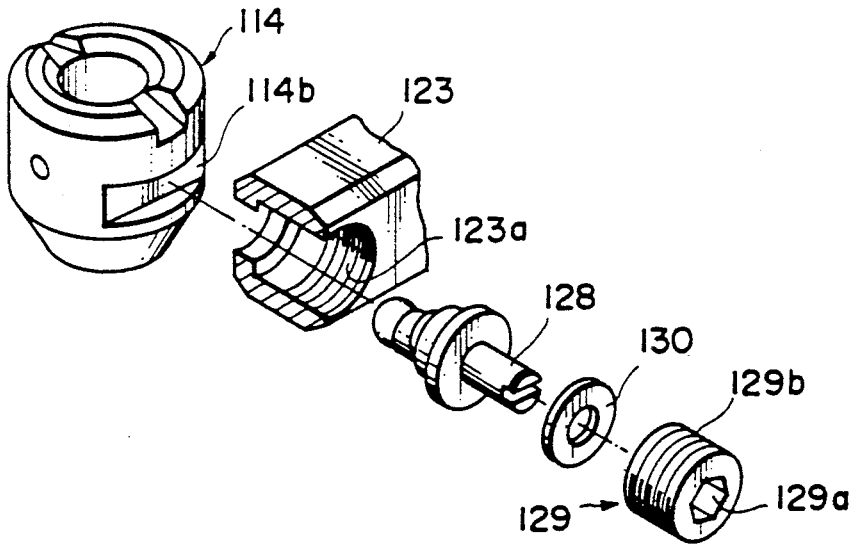
FIG. 5 is an exploded perspective view of the control rod and its peripheral parts.

In FIG. 3, reference numeral 126 designates a control rod engaging the control sleeve 114 and extending in a direction perpendicular to the plunger 108 and rotatable about its own axis for varying the axial position of the control sleeve 114 relative to the plunger 108. As shown in FIG. 5, the control rod 126 comprises a main body 123 formed therein with a plurality of threaded through bores 123*a* (only one of them is shown) facing respective control sleeves 114. A lever 128 is mounted in each threaded through bore 123*a* via a washer 130 and fastened in place by a lock screw 129 threadedly fitted in the bore 123*a*. The lock screw 129 has a through hole 129*a* through which an end portion of the lever 128 extends, and has a threaded outer peripheral surface engaging with the threaded through bore 123*a*.

The lever 128 has its tip slidably engaged in a circumferential groove 114*b* formed in the control sleeve 114 as shown in FIG. 3. Thus, the lever 128 transmits rotational movement of the rod main body 123 to the control sleeve 114 to cause same to axially move.

Figure 6:
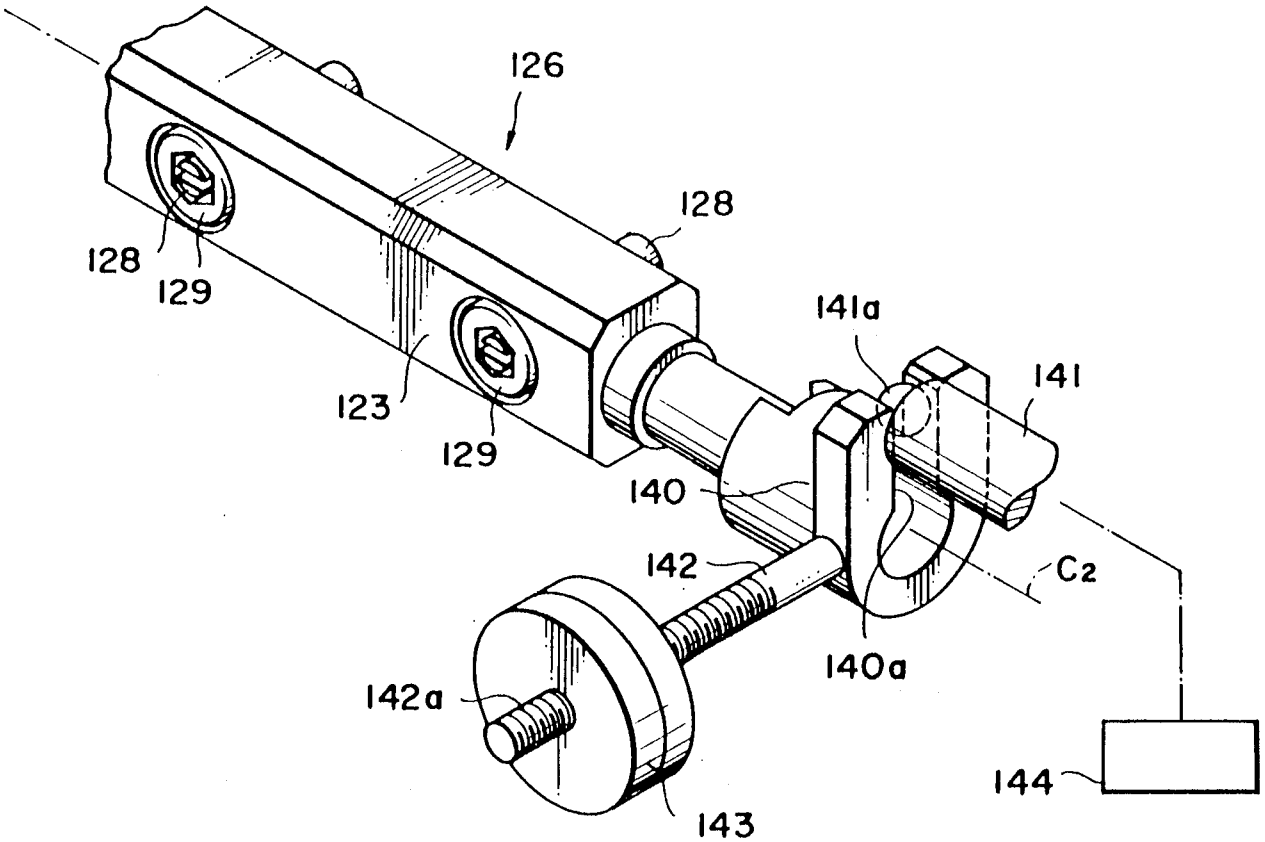
FIG. 6 is a perspective view of essential parts of a prestroke control device according to a first embodiment of the invention.

A U-shaped link (engaging member) 140 is secured to an end of the control rod 126, as shown in FIG. 6. The U-shaped link 140 has an engaging groove 140*a* formed therein and in which is engaged a ball 141*a* secured to a tip of an output shaft 141 of a prestroke actuator 144. A weight-supporting rod 142 is secured to a side wall of the U-shaped link 140 and extends perpendicularly to a central axis $C_2$ of the control rod 126.

Figure 7:
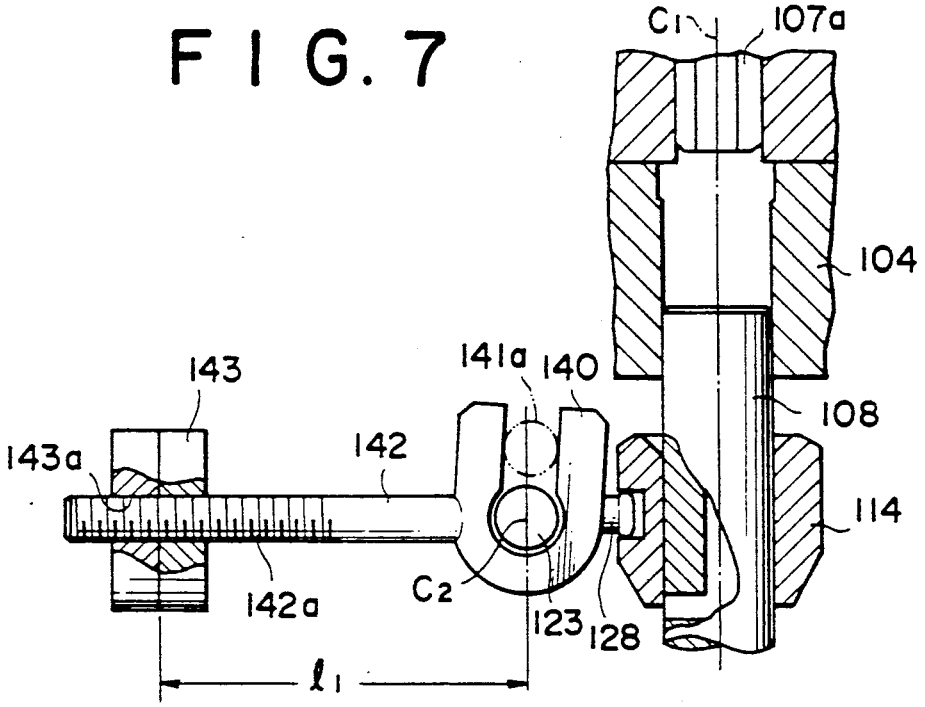
FIG. 7 is a side view of same, partly in section.

The rod 142 has a free end on which are fitted two balancing weights (counterweight) 143. As shown in FIG. 7, the position of the balancing weights 143 is adjusted to a point spaced from the central axis $C_2$ of the control rod 126 in a direction away from the plunger 108 by such a distance $l_1$ that the moment produced by the mass including the balancing weights 43 on the side remote from the plunger 108 with respect to the central axis $C_2$ is substantially equal to the moment produced by the total weight of the control sleeves 114 on the plunger side with respect to the central axis $C_2$. It has been experimentally ascertained that the object of the invention may be attained if the moment on the balancing weight side with respect to the central axis $C_2$ is at least half of the moment on the control sleeve side.

The weight-supporting rod 142 has a threaded outer peripheral surface 142*a* while the balancing weights 143 have tapped inner peripheral surfaces so that the latter is mounted on the former by screwing. Thus, the balancing weights 143 can be manually rotated to vary their position and hence the distance $l_1$, in accordance with the number of cylinders of the engine, variations in weight between associated pump parts, etc.

In the present embodiment, control sleeve driving means is formed of the control rod 126, the prestroke actuator 144, and the U-shaped link 140.

The prestroke actuator 144 comprises a driving section and a prestroke position sensor section. The , driving section may be a conventional one, e.g. comprised of a coil, a core, a rotor, and the output shaft 141 rotatively driven by the rotor, similarly to the conventional one shown in FIG. 2.

The prestroke control device according to the first embodiment operates as follows:

When the camshaft 112 is rotatively driven by the output shaft of the engine, the roller 125*a* of the tappet 125 is vertically moved to cause the plunger 108 to effect one cycle of reciprocating motion per one rotation of the camshaft 112*a*.

More specifically, fuel injection is performed as shown in FIGS. 4 (a)–(d), in which it is assumed that the position of the control sleeve 114 remains constant. When the plunger 108 is in a position shown in FIG. 4 (a) relative to the control sleeve 114, wherein the opening 108*b* is not yet closed by the control sleeve 114, the pressurizing chamber 120 still communicates with the fuel chamber 115 so that no pressure delivery of fuel takes place. When the plunger 108 is further lifted so that the opening 108*b* is closed by the control sleeve 114 as shown in FIG. 4 (b), the pressurizing chamber 120 becomes disconnected from the fuel chamber 115 and accordingly the pressure within the pressurizing chamber 120 starts to increase. When the plunger 108 is further lifted as shown in FIG. 4 (c), the pressure within the pressurizing chamber 120 surpasses the force of the spring 107*b* to open the valve body 107*a* so that pressurized fuel is discharged through the delivery valve. Then, when the plunger 108 is further lifted so that the inclined groove 108*d* comes across the control port 114*a* as shown in FIG. 4 (d), the pressurizing chamber 120 is brought into communication with the fuel chamber 115 via the fuel passage 108*a*, the opening 108*b*, and the groove 108*c* so that the pressure within the pressurizing chamber 120 suddenly drops and accordingly the pressure delivery is terminated.

The prestroke actuator 144 operates such that the output shaft 141 is rotated to cause the U-shaped link 140 and hence the control rod 126 to rotate about its own axis or central axis $C_2$. As the control rod 126 is thus rotated, the lever 128 is pivoted about the central axis $C_2$ of the control rod 126 so that the control sleeve 114 axially slides along the plunger 108, thus varying the prestroke of the plunger 108. For example, when the control rod 126 is rotated in the counterclockwise direction as viewed in FIG. 3, the control sleeve 114 downwardly slides along the plunger 108 toward the camshaft 112 so that the prestroke varies to a smaller value and hence the fuel injection timing is advanced. On the other hand, when the control rod 126 is rotated in the clockwise direction as viewed in FIG. 3, the control sleeve 114 upwardly slides along the plunger 108 toward the delivery valve so that the prestroke varies to a larger value and hence the fuel injection timing is retarded.

If due to vibrations transmitted from the engine or the vehicle during running or vibrations of the pump per se, a force is caused to act upon the control sleeves 114 slidably fitted on the plunger 108, which tends to move the control sleeves 114 in the axial directions $C_1$ of the plunger 108, the above force is transmitted through the control sleeves 114 to the control rod 126 to act upon the latter to rotate same. However, the balancing weights 143 act as a counterweight against the force to cancel same. Vibrations transmitted to the control rod 126 are thus absorbed. Consequently, the control sleeves 114 are prevented from oscillating in the axial directions $C_1$ due to the vibrations, whereby the prestroke of the plunger can be prevented from fluctuating and hence can be stabilized. Further, the prestroke control according to the invention can also contribute to reduction of the wear of component parts of the pump.

Figure 8:
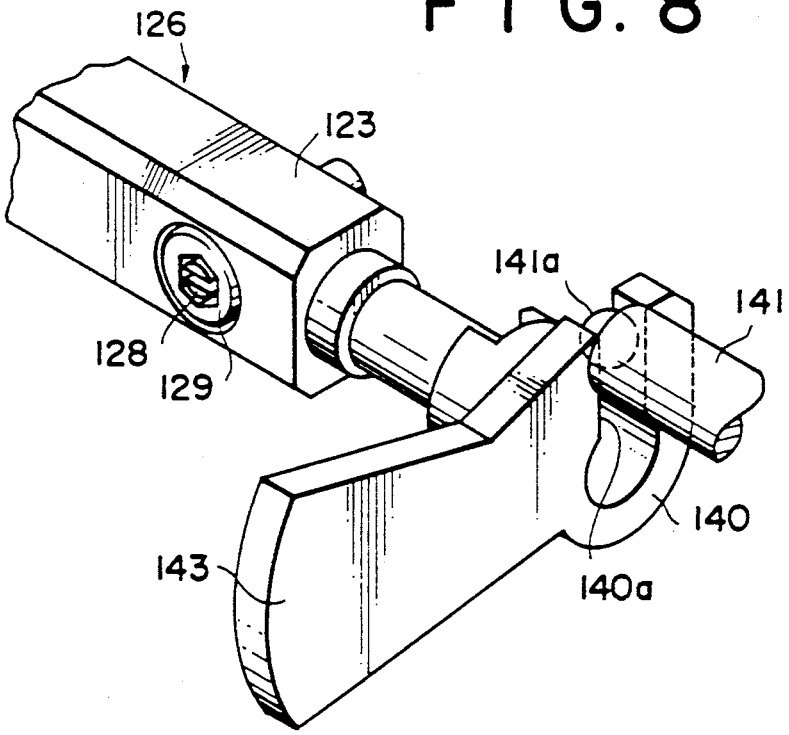
FIG. 8 is a fragmentary perspective view of a variation of the first embodiment of the invention.

FIG. 8 shows a variation of the first embodiment of the invention described above. According to the variation, a plate-like protuberance 143 as a balancing weight is formed integrally on a side wall of the U-shaped link 140 remote from the control sleeve 114. The protuberance 143 extends laterally or perpendicularly to the central axis $C_2$ of the control rod 126.

Figure 9:
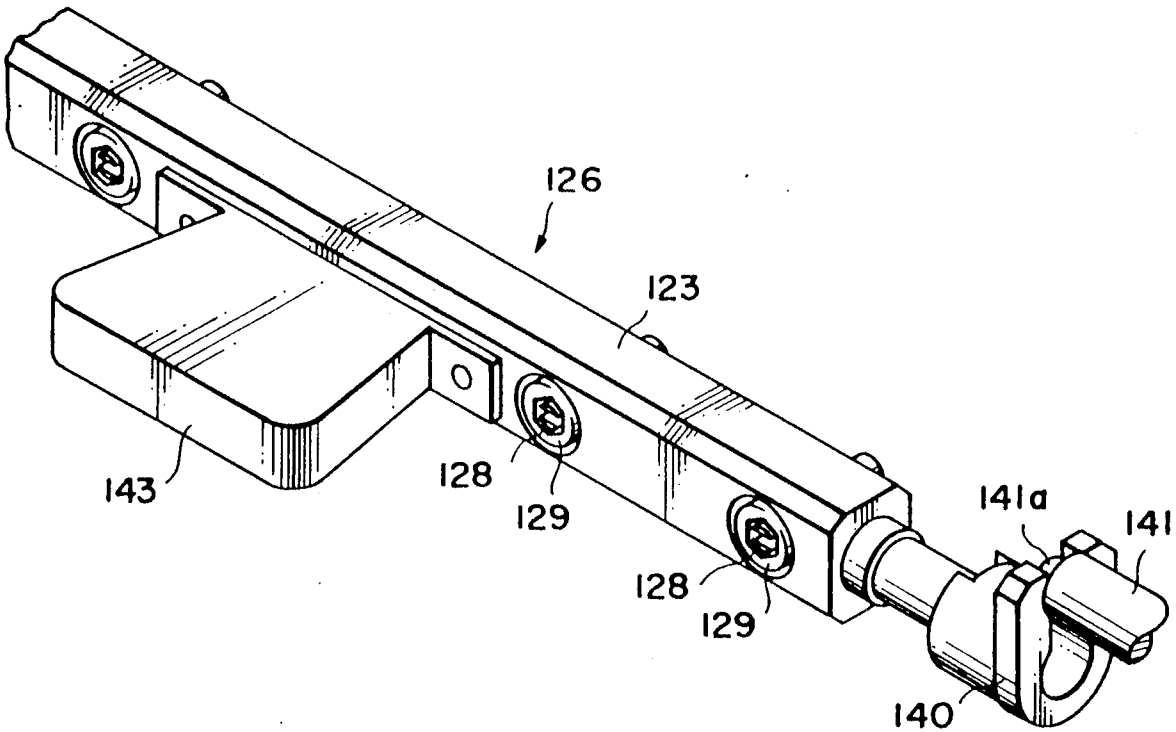
FIG. 9 is a fragmentary perspective view of another variation of the first embodiment.

FIG. 9 shows another variation of the first embodiment, in which a plate-like balancing weight 143 is fastened by set screws to a side wall of the main body 123 of the control rod 126 remote from the control sleeves 114.

These variations can also provide similar results to those obtained by the first embodiment described above.

Figure 10:
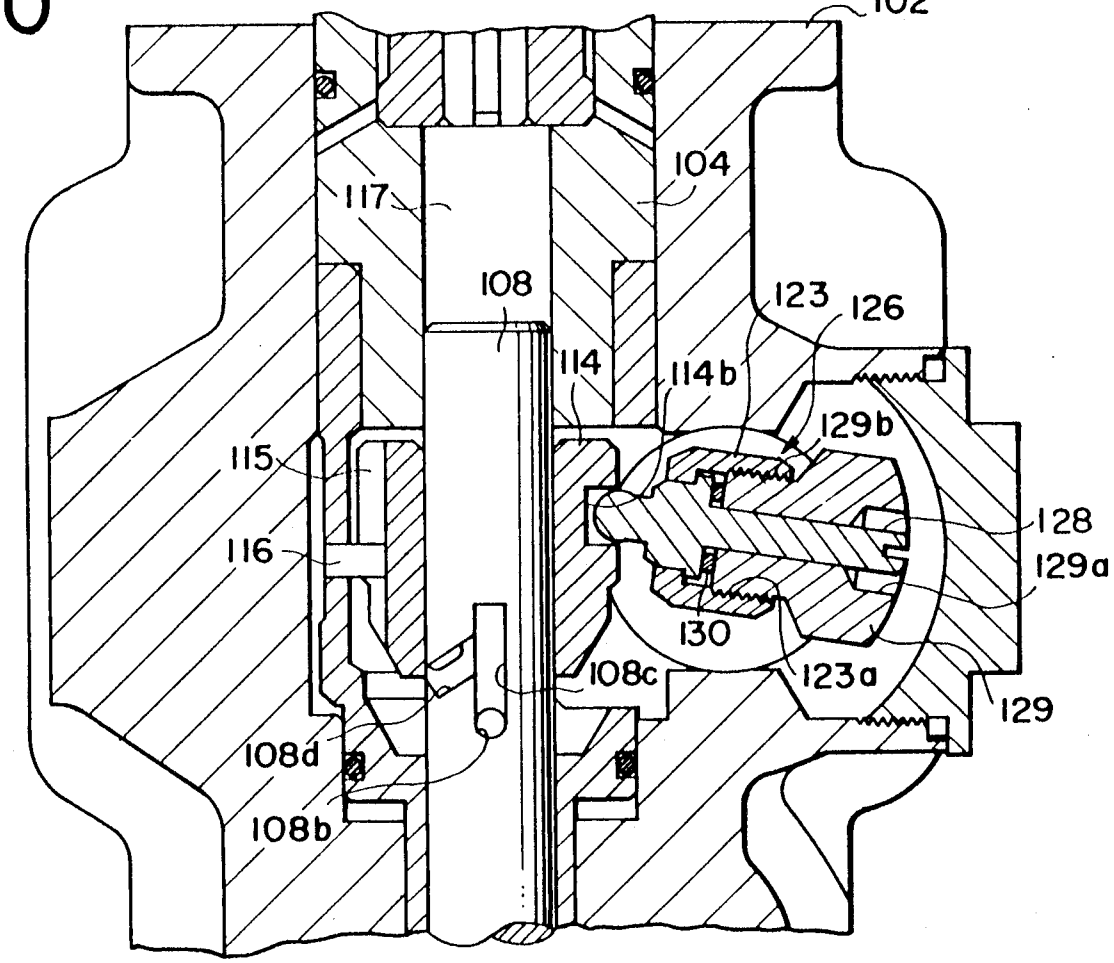
FIG. 10 is a fragmentary longitudinal sectional view of a fuel injection pump incorporating a prestroke control device according to a second embodiment of the invention.
Figure 11:
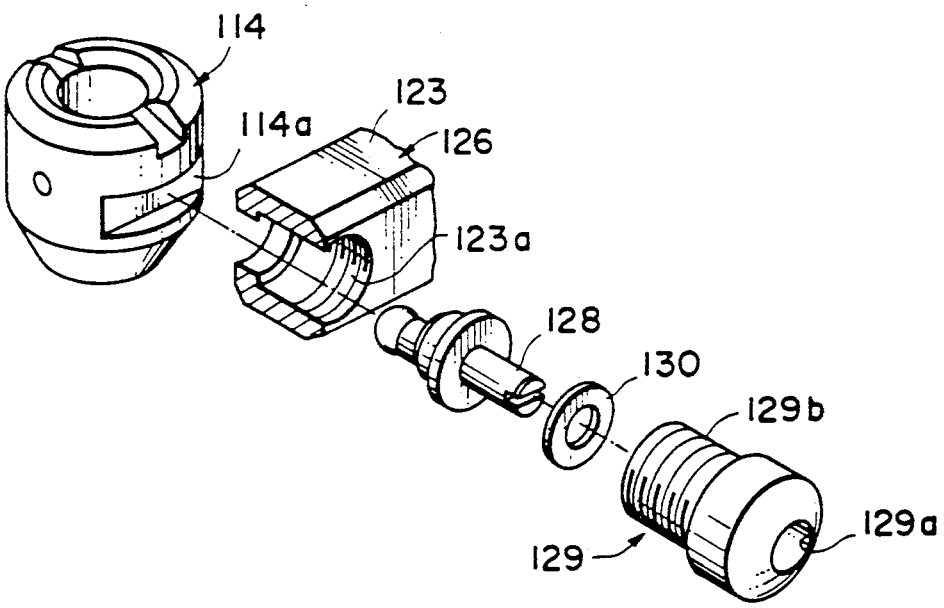
FIG. 11 is an exploded perspective view of essential parts of the second embodiment.

FIGS. 10 and 11 show a second embodiment of the invention. According to the second embodiment, a lock screw 129 having an increased weight is used in place of the counterweight 143 used in the first embodiment. As shown in the figures, one end portion of the lock screw 129 toward the control sleeves 114 has its outer peripheral surface formed with a screw thread 129*b*, while the other end portion remote from the control sleeves 114 is largely swelled or thickened so that the whole lock screw 129 has an increased weight as compared with a conventional one. Therefore, the lock screw 129 with increased weight acts as a counterweight upon the control sleeves 114, providing similar results to those of the balancing weights 143 of the first embodiment.

Figure 12:
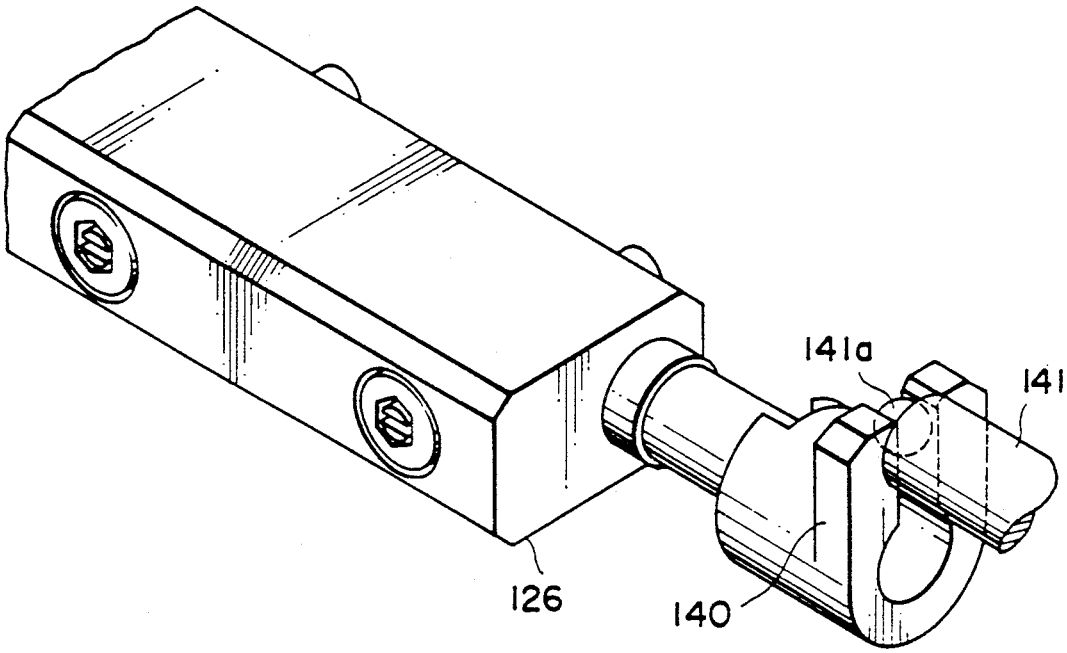
FIG. 12 is a fragmentary perspective view of essential parts of a third embodiment of the invention.
Figure 13:
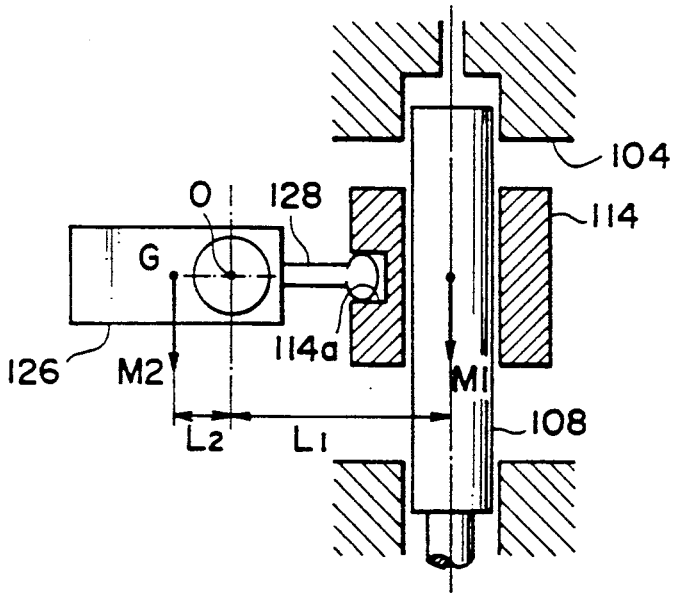
FIG. 13 is a diagrammatic view of the third embodiment of the invention.

FIGS. 12 and 13 show a third embodiment of the invention. According to this embodiment, the control rod 126 has a rectangular cross section, and has a center of gravity G eccentrically located on a side remote from the control sleeves 114 with respect to the axis of rotation of the control rod 126.

On the other hand, the center of gravity of the control sleeves 114 is nearly located on the axes of the respective plungers 108, like a conventional arrangement. The component parts are so arranged and sized as to satisfy the following equation:

$$M_1 \times L_1 = M_2 \times L_2$$

where $M_1$ represents the weight of the control sleeves 114, $M_2$ the weight of the control rod 126, $L_1$ the distance between the center of gravity of the control sleeves 114 and the axis of rotation 0 of the control rod 126, and $L_2$ the distance between the center of gravity G of the control rod 126 and the axis of rotation 0 of same.

The rotating force acting upon the control rod 126 due to vibrations of the engine, etc. is cancelled by the control rod 126 per se, which acts as the counterweight, because its center of gravity G is eccentric with respect to the axis of rotation thereof.

Since in the present embodiment the control rod 126 itself has the function of a balancing weight, it is unnecessary to provide a separate balancing weight, thus enabling to design the prestroke control device compact in size and easy to assemble.

Figure 14:
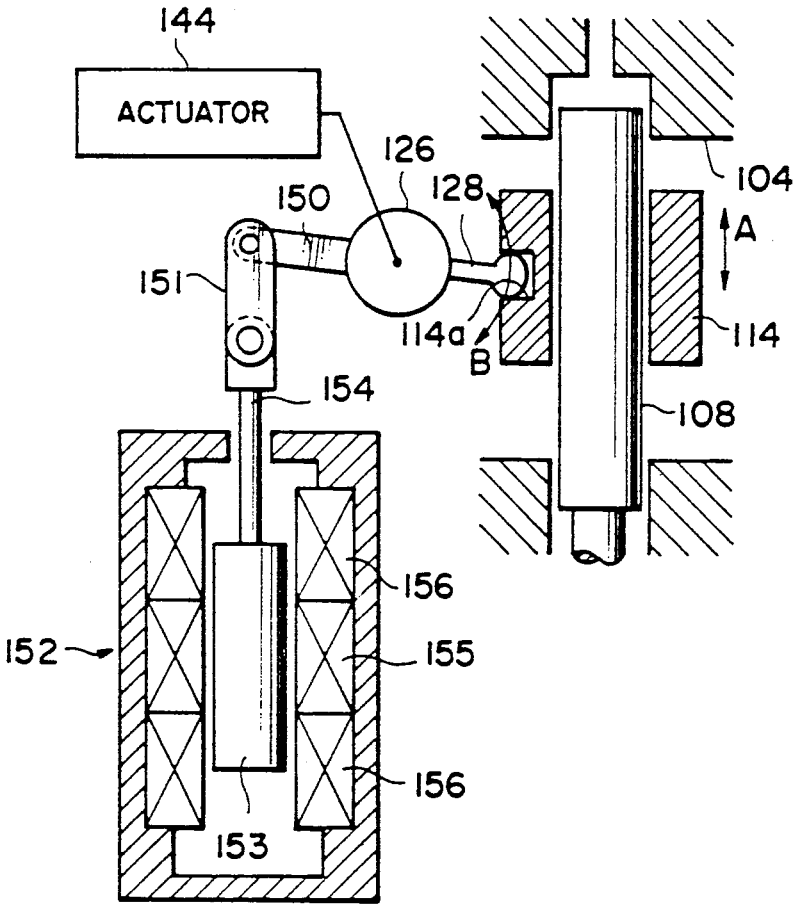
FIG. 14 is a diagrammatic view of a fourth embodiment of the invention.

FIG. 14 shows a fourth embodiment of the invention. In the fourth embodiment, an arm 150 extends from the control rod 126 in a direction away from the control sleeves 114. The arm 150 may extend from the main body 123 of the control rod 126 per se or from the U-shaped link 140 of the actuator 144. An end of the arm 150 is coupled to an end of a rod 154 extending from a moving core 153 of a differential transformer 152, via a link 151 which converts a pivotal motion of the arm 150 to a linear motion.

The differential transformer 152 is a conventional linear-motion type having a primary coil 155 and two secondary coils 156, 156 and adapted to generate a signal indicative of the position of the moving core 153. The differential transformer 152 is disposed such that the moving core 153 is movable in a direction parallel with the axis of the plunger 108. The moving core 153 acts as a counterweight which is weightwise balanced with the control sleeves 114. To this end, the weight of the moving core 153 and the length of the arm 150 are so set that the moving core 153 is weightwise balanced with the control sleeves 114.

In this embodiment, the moving core 153 of the differential transformer 152 acts to resist the rotating force acting upon the control rod 126 due to vibrations of the engine, etc, to thereby cancel the rotating force.

Furthermore, the differential transformer 152 performs its proper function of detecting rotational displacement of the control rod 126 in such a manner that the moving core 153 is displaced by an amount corresponding to the amount of rotation of the control rod 126, and the coils generate a signal indicative of the amount of displacement of the moving core 153. Thus, the rotational displacement of the control rod 126 can be determined from the above signal to thereby detect the position of the control sleeves 114.

As described above, according to the present embodiment, a part (moving core 153) of a sensor (differential transformer 152) for measuring the rotational displacement of the control rod 126 and hence the amount of displacement of the control sleeves 114 is utilized as the counterweight as well, thereby reducing the number of component parts.

Further, according to the present embodiment, since the differential transformer 152 is disposed parallel with the plungers 108, even if a vibrating force is applied to the arrangement of FIG. 14 in a leftward or rightward direction as viewed in the figure, the moving core 153 will not generate an undesirable rotating force. More specifically, if the moving core 153 were disposed to move in directions other than directions parallel with the axes of the plungers 108, when a vibrating force is applied in the leftward or rightward direction as viewed in FIG. 14, a component of force is generated in the moving direction of the moving core 153, which acts to move the moving core 153. This causes an undesirable rotating force acting upon the control rod 126, resulting in movement of the control sleeves 114.

On the other hand, according to the FIG. 14 embodiment, since the moving direction of the moving core 153 is limited to the same direction in which the control sleeves 114 are moved, the moving core 153 will not move even if the leftward or rightward vibrating force is applied thereto, so that no undesirable rotating force is generated. That is, with the FIG. 14 arrangement, any vibration can be effectively absorbed, irrespective of the direction in which it is applied to the arrangement.

Figure 15:
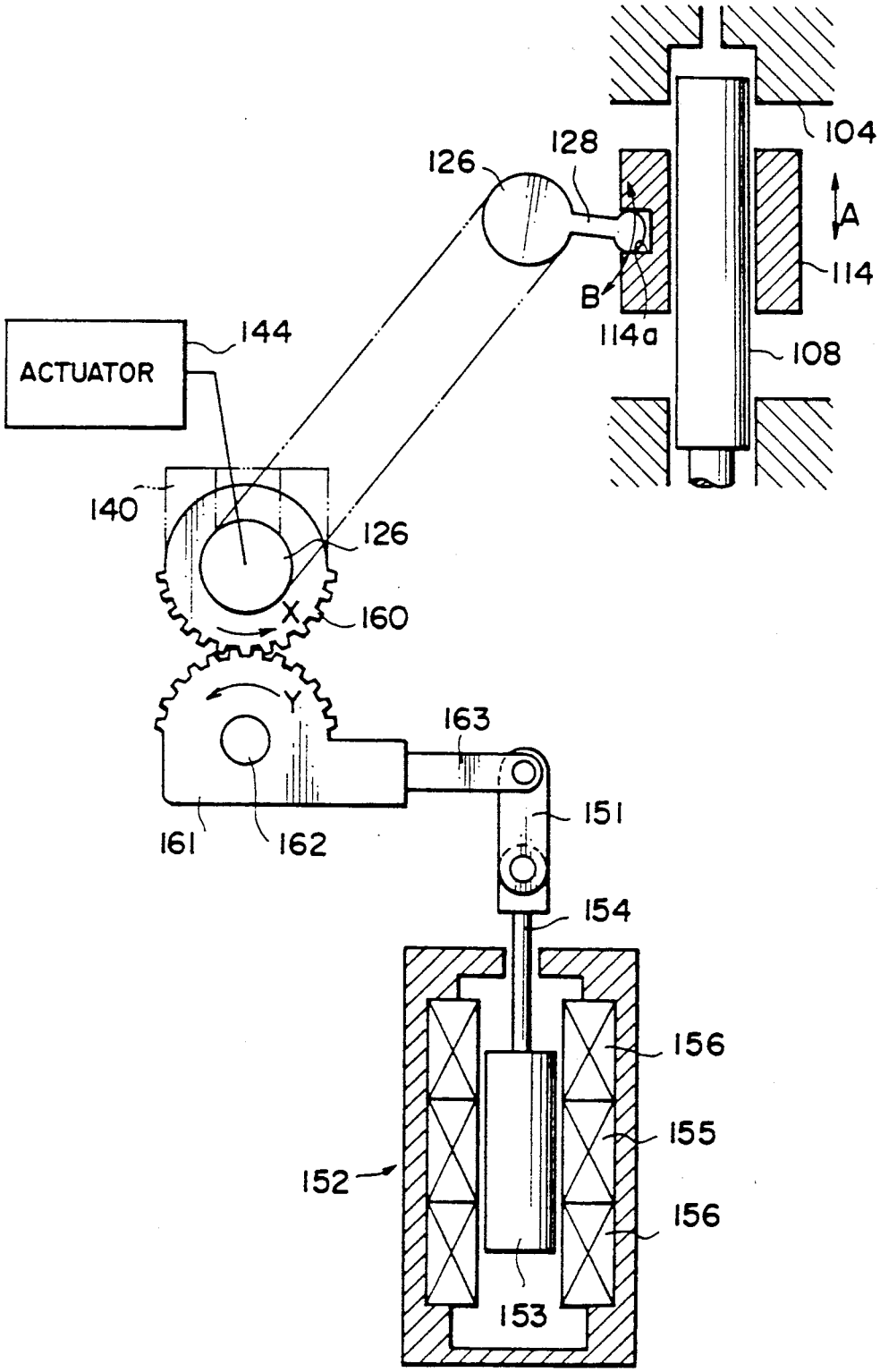
FIG. 15 is a diagrammatic view of a fifth embodiment of the invention.

FIG. 15 shows a fifth embodiment of the invention. In FIG. 15, the right upper control rod 126 and the left lower one are the same, but it is illustrated in two bodies for the convenience of illustration.

In the embodiment, the U-shaped link 140 at an end of the control rod 126 has part of its periphery formed with a toothed portion 160 which is in engagement with a reversing gear 161. The reversing gear 161 is arranged right under the U-shaped link 140 for rotation about a rotary shaft 162 extending parallel with the control rod 162. The two gears 160, 161 have almost the same pitch circle such that the reversing gear 161 rotates in a reverse direction to that of the control rod 126 by the same angular amount as the latter.

Like the U-shaped link 140, the reversing gear 161 has part of its periphery formed with a toothed portion. A rod 163 extends from the reversing gear 161 toward the control sleeves 114 with respect to the rotary shaft 162, and has an end coupled to the rod 154 extending from the moving core 153 of the differential transformer 152, which senses rotational displacement of the control rod 126, via the link 151. Also in this embodiment, the moving core 153 of the transformer 152 serves as the counterweight which is weightwise balanced with the control sleeves 114 via the reversing gear 161 and the control rod 126.

The present embodiment constructed as above operates as follows:

When a rotating force due to vibrations of the engine, etc. acts upon the control rod 126, the moving core 153 is about to move in the same direction as the control sleeves 114. However, when the moving core 153 starts to move, it causes a rotating force acting upon the reversing gear 161 to rotate same in the same direction in which the control rod 126 is about to move.

More specifically, in FIG. 15, if the control sleeves 114 start to upwardly move due to a vibration, the control rod 126 is about to rotate in a direction indicated by the arrow X. At the same time, also the moving core 153 is about to upwardly move due to the above vibration, and accordingly acts upon the reversing gear 161 to rotate same in a direction indicated by the arrow Y. That is, when a vibration is applied, the control rod 126 and the reversing gear 161 are about to rotate in the same direction. However, the rotating force of the reversing gear 161 is transmitted to the control rod in the form of a rotating force causing same to rotate in the opposite direction. Consequently, the rotating force generated by the control rod 126 and one generated by the reversing gear 161 cancel each other, so that the control rod 126 does not rotate, and thus the vibration applied to the control sleeves 114 is absorbed. Therefore, the control sleeves 114 will not move even upon receiving vibration, whereby the prestroke control can be stably performed.

Furthermore, according to the present embodiment, since the control sleeves 114 and the moving core 153 are balanced with each other via the reversing gear 161, the differential transformer 152 can be arranged on the control sleeve 114 side with respect to the axis of the control rod 126, thus avoiding that the differential transformer outwardly projects, occupying a large space, and hence enabling to design the whole pump compact in size.

Figure 2:
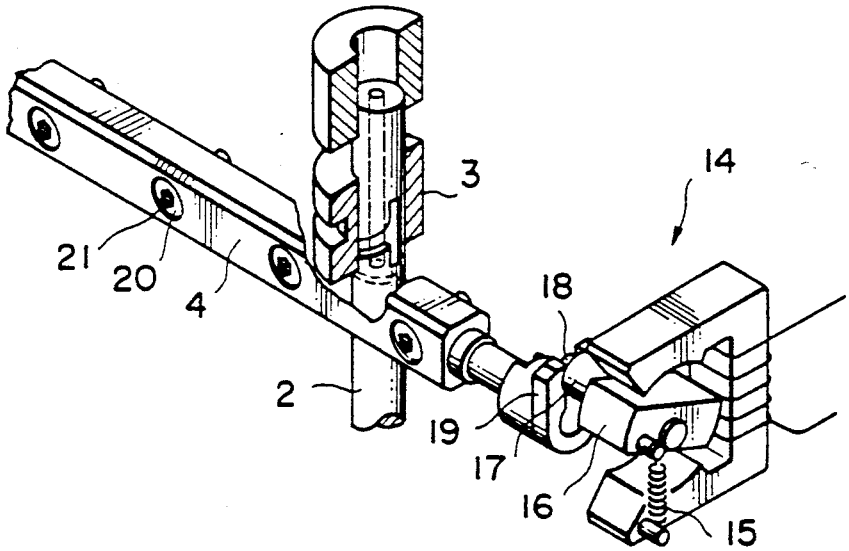
FIG. 2 PRIOR ART
FIG. 2 is a perspective view of the conventional prestroke control device.
Figure 16:
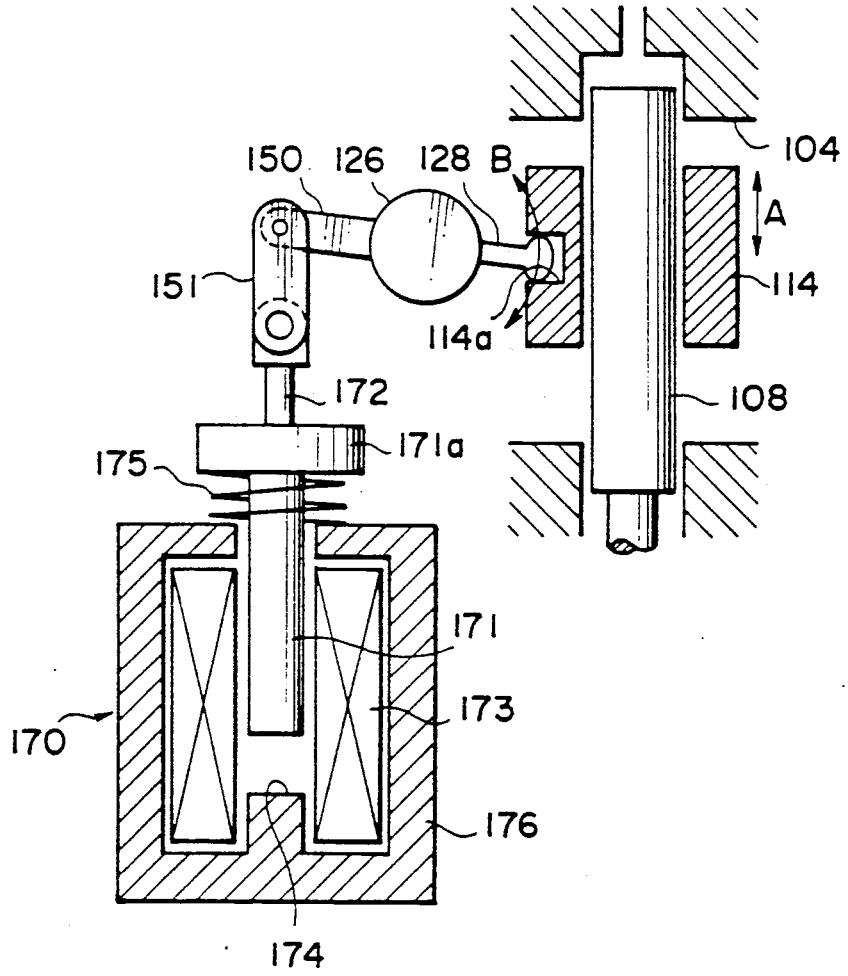
FIG. 16 is a diagrammatic view of a sixth embodiment of the invention.

FIG. 16 shows a sixth embodiment of the invention. According to this embodiment, a linear-motion type electromagnetic actuator 170 is employed as the prestroke actuator in place of a rotary type electromagnetic actuator as shown in FIG. 2. The arm 150 extending from the control rod 126 in a direction away from the control sleeves 114 has an end thereof coupled via the link 151 to an end of a rod 172 extending from a moving core 171 of the linear-motion type electromagnetic actuator 170. An end of the moving core 171 on the rod 172 side is formed integrally with a collar 171*a*, and a coiled spring 175 is interposed between the collar 171*a* and a casing 176 of the actuator 170.

The electromagnetic actuator 170 operates such that when the coil 173 is energized, the moving core 171 is magnetically attracted toward a stationary core 174 for displacement by an amount corresponding to the energizing current, against the force of the spring 175. Also the actuator 170 is disposed with the moving core 171 being movable in directions parallel with the axes of the plungers 108. The moving core 171 of the electromagnetic actuator also serves as the counterweight weightwise balanced with the control sleeves 114.

When the coil 173 of the electromagnetic actuator 170 is energized, the moving core 171 is displaced to cause the arm 150 to be pivotally moved via the link 151 to thereby rotate the control rod 126. The rotating rod 126 in turn pivotally moves the levers 128 in a direction indicated by the arrow B so that the control sleeves 114 axially slide (in a direction indicated by the arrow A) to thereby control the prestroke.

When the control sleeves 114 start to axially move due to vibration of the engine, etc., initial movement of the control sleeves 114 is transmitted in the form of a rotating force acting upon the control rod 126. The moving core 171 of the electromagnetic actuator 170 acts as the counterweight resisting the rotative movement of the control rod 126 and hence cancels the rotating force. Thus the control sleeves 14 are prevented from axial movement due to the vibration and the prestroke control can be stably performed.

Further, like the fourth embodiment described above, since the electromagnetic actuator is disposed parallel with the plungers 108, vibrations applied in any direction can be effectively absorbed. Besides, also in this embodiment, the use of the moving core 171 of the electromagnetic actuator 170 as the counterweight as well contributes to reduction in the number of component parts employed.

Figure 17:
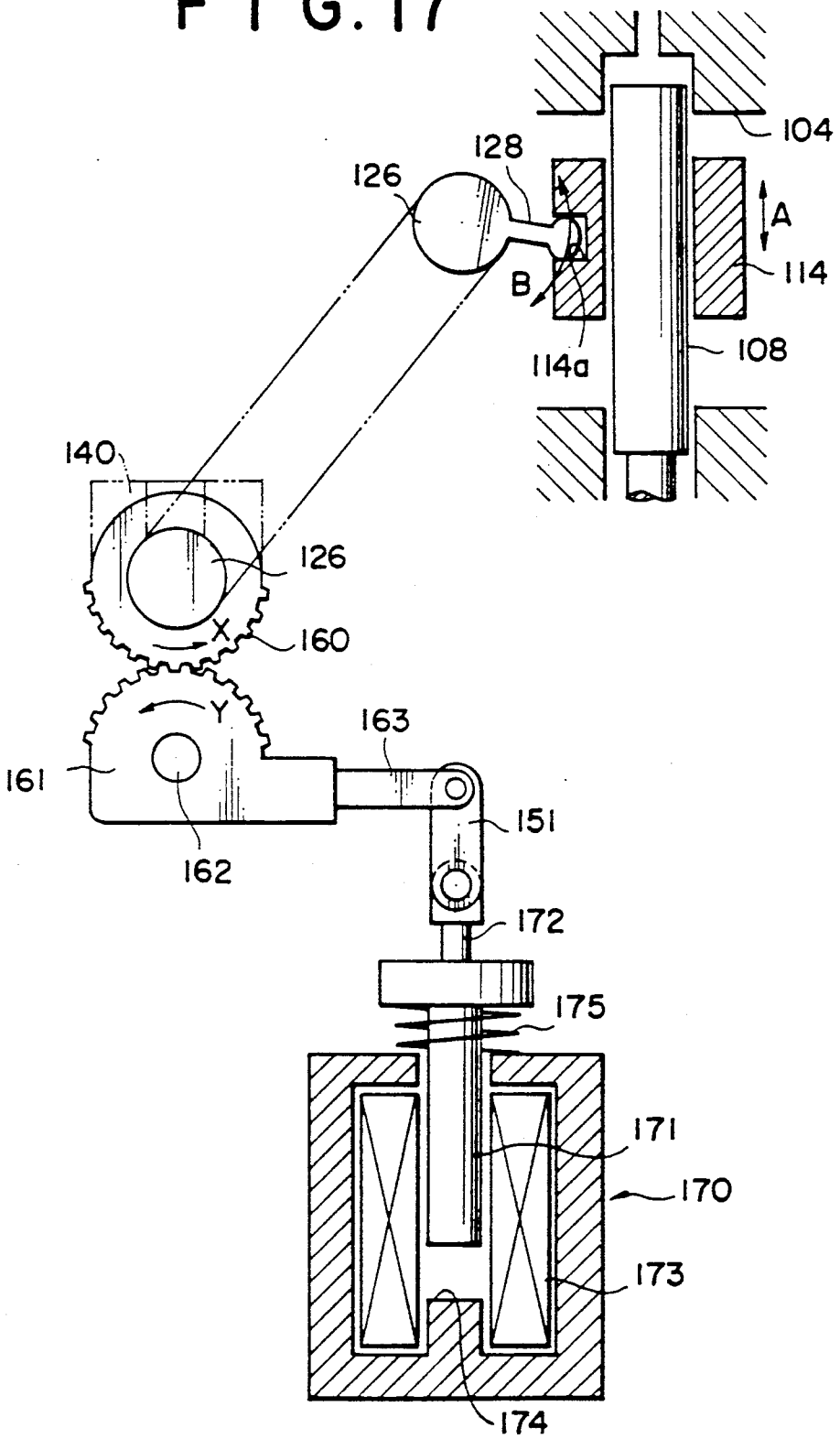
FIG. 17 is a diagrammatic view of a seventh embodiment of the invention.

FIG. 17 shows a seventh embodiment of the invention. This embodiment is distinguished from the fifth and sixth embodiments described above only in that the linear-motion type electromagnetic actuator is employed as the prestroke actuator like the sixth embodiment, and the moving core 171 of the electromagnetic actuator 170 is coupled to the control rod 126 via the reversing gear 161, like the fifth embodiment.

When the actuator 170 is actuated, the resulting rotating force is transmitted through the reversing gear 161 to the control rod 126 to move the control sleeves 114. Thus the prestroke is controlled.

On the other hand, a vibration applied to the control sleeves 114 to axially move same is absorbed by the moving core 171 of the actuator 170 in the same manner as the fifth embodiment, whereby the prestroke control is stably performed.

Figure 18:
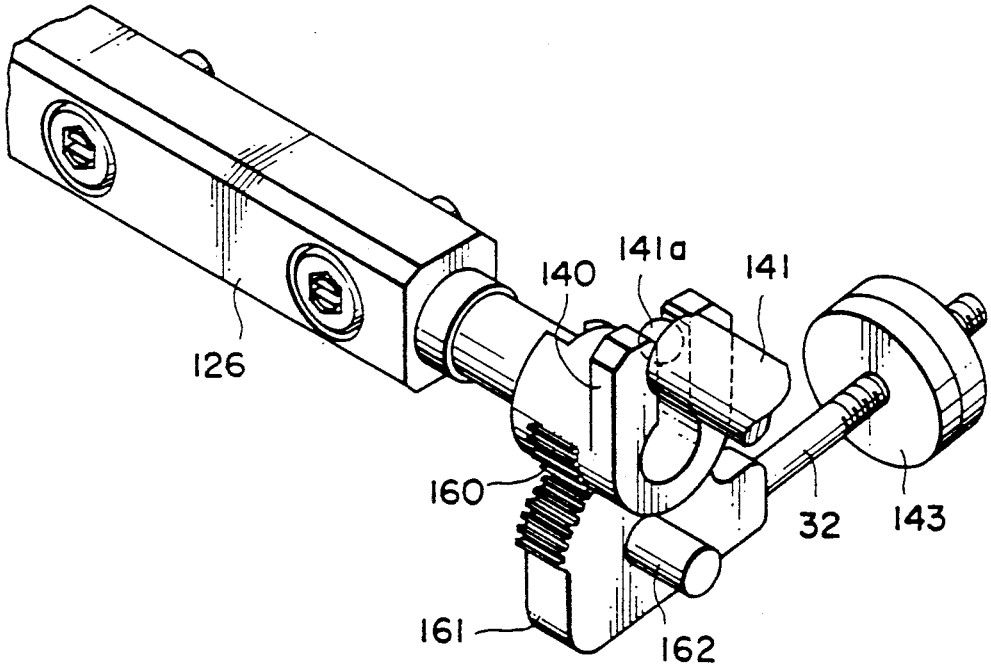
FIG. 18 is a perspective view of essential parts of an eighth embodiment of the invention.
Figure 19:
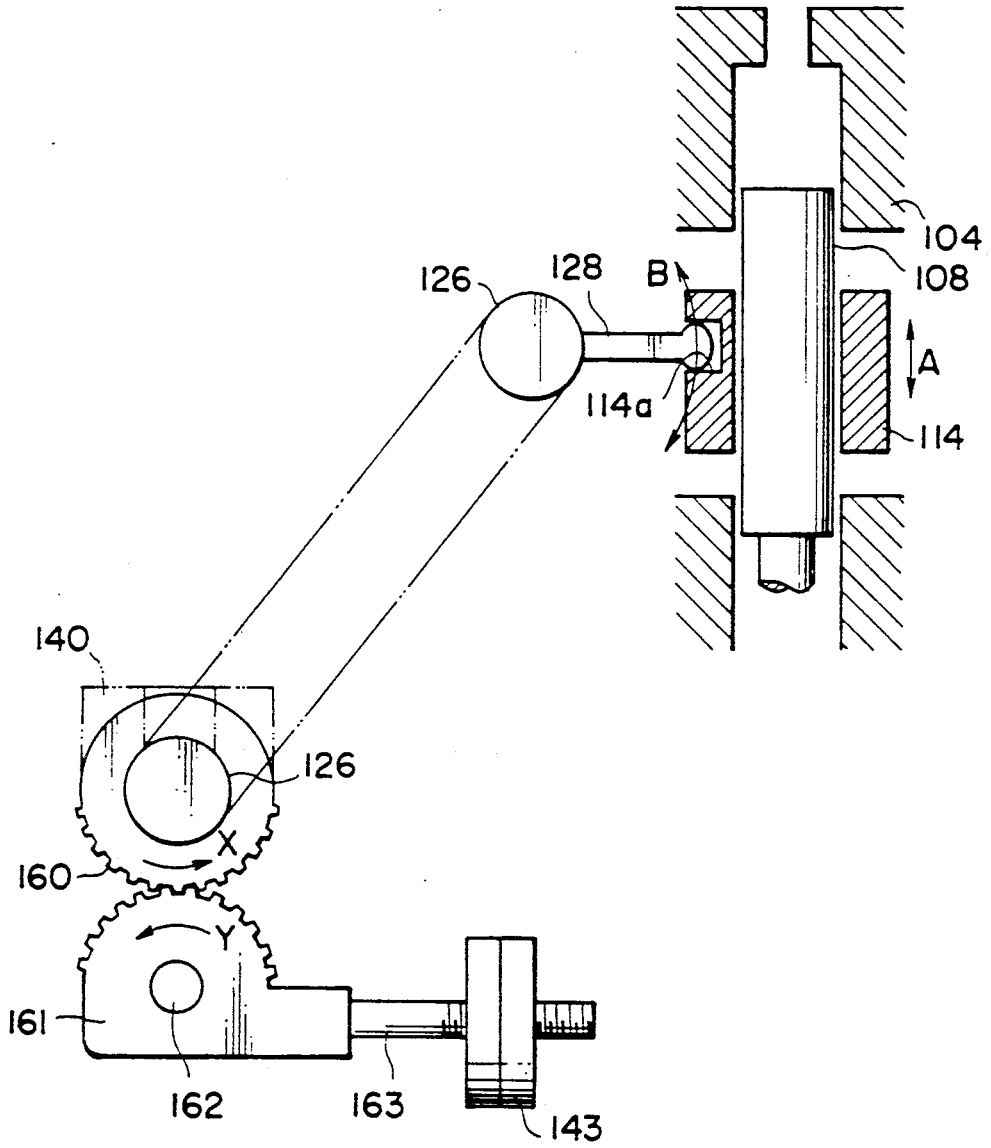
FIG. 19 is a diagrammatic view of the eighth embodiment.

FIGS. 18 and 19 show an eighth embodiment of the invention. This embodiment is distinguished from the seventh embodiment described above only in that the balancing weight 143 is employed as the counterweight weightwise balanced with the control sleeve 114, in place of the electromagnetic actuator 170. This embodiment has similar operation and results to the seventh embodiment.

Figure 20:
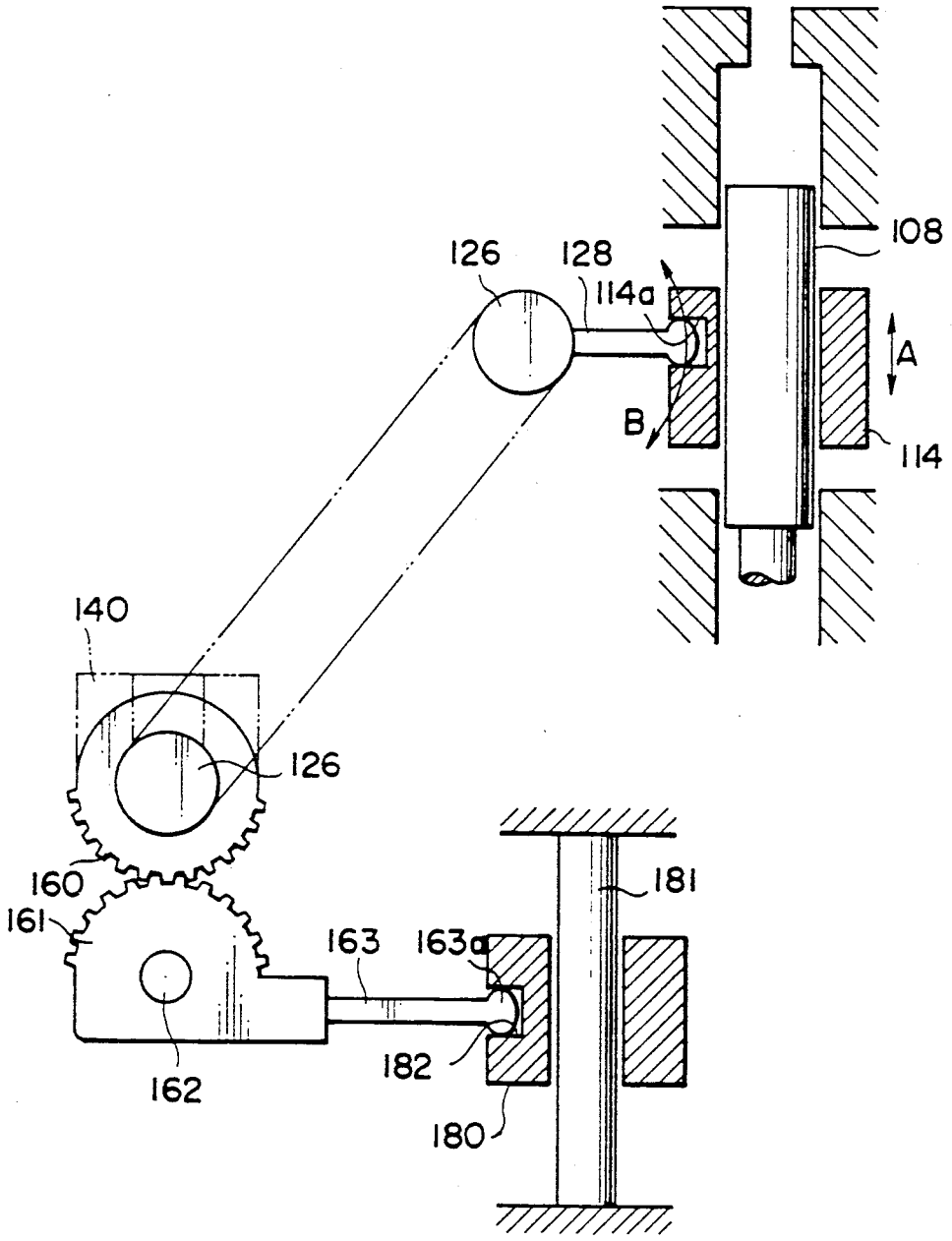
FIG. 20 is a diagrammatic view of a ninth embodiment of the invention.

FIG. 20 shows a ninth embodiment of the invention. This embodiment is distinguished from the eighth embodiment described above only in that a counterweight 180 is employed in place of the counterweight 143. The counterweight 180 is slidably fitted on a guide rod 181 extending parallel with the axis of the plunger 108. A spherical end 163*a* of a rod 163 extending from the reversing gear 161 is engaged in a groove 182 formed in an outer peripheral surface of the counterweight 180. The engagement of the rod 163 and the counterweight 180 is similar in structure to that of the control sleeves 114 and the control rod 126.

When a vibration is applied in an upward or downward direction, it is effectively absorbed in a similar manner to the eighth embodiment described above.

Further, according to this embodiment, the moving direction of the counterweight 180 is limited to the same direction as that of the control sleeves 114 by means of the guide rod 181, providing excellent results which cannot be obtained by the eighth embodiment, as follows:

First, suppose that there is no limitation on the moving direction of the counterweight 180. When a vibrating force is applied to the FIG. 20 arrangement in the leftward or rightward direction (in the direction perpendicular to the axes of the plungers 108) as viewed in the figure, a rotating force can be generated in the reversing gear 161, depending upon the position then assumed by the counterweight 180. However, no rotating force is generated in the control rod 126 even if the same vibrating force is applied to the control sleeves 114, because the sleeves are supported by the plungers 108. Therefore, the above rotating force generated by the counterweight 180 is transmitted to the control rod 126 as an undesirable rotating force which causes the control sleeves 114 to axially move.

On the other hand, according to the present embodiment, the counterweight 180 is only allowed to move in the directions parallel with the moving directions of the control sleeves 114. Therefore, even if a vibrating force is applied in the leftward or rightward direction, no undesirable rotating force is generated by virtue of the guide rod 181 impeding leftward or rightward movement of the counterweight 180. Thus, according to the present embodiment, vibrations can be effectively absorbed, irrespective of the direction in which the vibrating force is applied, always ensuring stable control of the position of the control sleeves 114.

Although in the fifth and seventh to ninth embodiments described above, a reversing gear is employed as the reversing means, other type reversing means may be employed. Further, the reversing means may be arranged at another place than between the control rod and the counterweight as in the described embodiments.

What is claimed is:

1. In a prestroke control device for a fuel injection pump having at least one plunger, said device including at least one control sleeve slidably fitted on a corresponding one of said at least one plunger, a control rod having a lateral peripheral surface thereof engaging said control sleeve, said control rod extending perpendicularly to said plunger and tangentially thereto, said control rod being rotatable about an axis thereof for varying an axial position of said control sleeve relative to said plunger to thereby control a prestroke of said plunger, and actuator means for rotatively driving said control rod about said axis thereof, the improvement comprising counterweight means comprising a weight having a center of gravity located on a side remote from said control sleeve with respect to said axis of said control rods, said counterweight means being movable in unison with rotation of said control rod for cancelling a rotating force generated by axial movement of said control sleeve and acting upon said control rod.

2. In a prestroke control device for a fuel injection pump having at least one plunger, said device including at least one control sleeve slidably fitted on a corresponding one of said at least one plunger, a control rod engaging said control sleeve, said control rod extending perpendicularly to said plunger and rotatable about a control rod axis for varying an axial position of said control sleeve relative to said plunger to thereby control a prestroke of said plunger, and actuator means having an engaging member secured to said control rod for rotation together therewith, for rotatively driving said control rod about said control rod axis, the improvement comprising counterweight means movable in unison with rotation of said control rod for cancelling a rotating force generating by axial movement of said control sleeve and acting upon said control rod, said counterweight means comprising a weight secured to said engaging member for pivotal movement in unison with rotation of said engaging member, said weight having a center of gravity located on a side of said control rod axis remote from said control sleeve.

3. In a prestroke control device for a fuel injection pump having at least one plunger, said device including at least one control sleeve slidably fitted on a corresponding one of said at least one plunger, a control rod engaging said control sleeve, said control rod extending perpendicularly to said plunger and rotatable about a control rod axis for varying an axial position of said control sleeve relative to said plunger to thereby control a prestroke of said plunger, and actuator means having an engaging member secured to said control rod for rotation together therewith, for rotatively driving said control rod about said control rod axis, the improvement comprising counterweight means movable in unison with rotation of said control rod for cancelling a rotating force generated by axial movement of said control sleeve and acting upon said control rod, said counterweight means comprising a supporting rod secured to said engaging member and at least one weight member carried by said supporting rod in a manner adjustable in position along said supporting rod, said weight member having a center of gravity located on a side of said control rod axis remote from said control sleeve.

4. In a prestroke control device for a fuel injection pump having at least one plunger, said device including at least one control sleeve slidably fitted on a corresponding one of said at least one plunger, a control rod engaging said control sleeve, said control rod extending perpendicularly to said plunger and rotatable about a control rod axis for varying an axial position of said control sleeve relative to said plunger to thereby control a prestroke of said plunger, and actuator means having an engaging member secured to said control rod for rotation together therewith, for rotatively driving said control rod about said control rod axis, the improvement comprising counterweight means movable in unison with rotation of said control rod for cancelling a rotating force generated by axial movement of said control sleeve and acting upon said control rod, said counterweight means comprising a weight in the form of a protuberance formed integrally on said engaging member for pivotal movement in unison with rotation of said engaging member, said weight having a center of gravity located on a side of said control rod axis remote from said control sleeve.

* * * * *